United States Patent [19]

Hooper et al.

[11] Patent Number: 4,605,203

[45] Date of Patent: Aug. 12, 1986

[54] PNEUMATIC JACK

[76] Inventors: Jack L. Hooper; Harold E. Radiel, both of 108 Cummings Ct., Antioch, Tenn. 37013

[21] Appl. No.: 707,962

[22] Filed: Mar. 4, 1985

[51] Int. Cl.[4] ..... B66F 3/24

[52] U.S. Cl. ..... 254/93 HP; 254/93 H

[58] Field of Search ..... 92/34–38; 254/93 HP, 93 H

[56] References Cited

U.S. PATENT DOCUMENTS

| | | | |
|---|---|---|---|
| 3,173,659 | 3/1965 | Hemmeter | 254/93 HP |
| 3,182,959 | 5/1965 | Hemmeter | 254/93 HP |
| 3,664,636 | 5/1972 | Sherrill | 254/93 HP |

*Primary Examiner*—Robert C. Watson

*Attorney, Agent, or Firm*—Harrington A. Lackey

[57] ABSTRACT

A pneumatic jack including a jack head adapted to be elevated by an expansible flexible bag member inflated with compressed air. A locking mechanism for holding the jack head in its elevated position, including a hydraulically controlled expansible plunger member connected to the jack head. The hydraulic fluid is introduced into the expansible plunger member through a check valve by the motive force of the compressed air. The jack head is lowered by relieving the compressed air within the bag member and by overriding the check valve to permit reverse flow of the hydraulic fluid from the extensible plunger member into a reservoir.

11 Claims, 2 Drawing Figures

PNEUMATIC JACK

BACKGROUND OF THE INVENTION

This invention relates to a pneumatic jack, and more particularly to a pneumatic jack having a hydraulic locking control.

Hydraulic jacks, as well as pneumatic jacks, are well known in the art.

Moreover, pneumatic jacks incorporating means for retarding the descent of the jack when the air pressure upon the jack is removed, are shown in the U.S. Hemmeter Pat. Nos. 3,173,659 and 3,182,959. The Hemmeter Pat. No. 3,173,659 discloses a pneumatic jack having a hydraulic damper and also a mechanical locking mechanism for holding the jack in elevated positions, even in the absence of compressed air. The Hemmeter Pat. No. 3,182,959 discloses a pneumatic jack in which the descent of the jack is retarded, but not stopped, by a hydraulic mechanism.

The following U.S. patents disclose various types of hydraulic jacks in which the motive power for the hydraulic fluid is supplied by compressed air acting upon an intermediate piston head;

U.S. Pat. No. 552,274 Cole Dec. 31, 1895
U.S. Pat. No. 957,536 Baker May 10, 1910
U.S. Pat. No. 1,418,651 Johnson June 06, 1922
U.S. Pat. No. 1,903,887 Widener April 18, 1933
U.S. Pat. No. 2,638,075 Towler May 12, 1953

However, all of the above patents disclose jacks in which the lifting is accomplished through the movement of the hydraulic fluid being acted upon by the compressed air. Moreover, the rise of the jack head is limited to the length of the hydraulic cylinder.

The U.S. Notenboom et al Pat. No. 3,279,755 issued Oct. 18, 1966, discloses a multi-stage hydraulic hoist.

The U.S. Moor Pat. No. 3,743,248 issued July 3, 1973, discloses a multi-stage pneumatic jack in which the telescoping cylindrical shaft sections are surrounded by a rubber bellows. However, the bellows are described as being for protection of the jack from dust and the elements, and do not have any lifting function whatsoever.

A pneumatic jack 130 incorporating a flexible air bag is disclosed in the Granning U.S. Pat. No. 3,235,181, issued June 13, 1967. However, the Granning pneumatic jack is not provided with any means for holding the jack in extended position, or retarding its collapse by any means, if the air pressure fails.

SUMMARY OF THE INVENTION

It is an object of this invention to provide a pneumatic jack having an annular flexible air bag defining a compressed air chamber for expansion to lift the jack head, in which the jack head is locked in its elevated position automatically by a hydraulic mechanism.

A pneumatic jack has several advantages over a hydraulic jack. First of all, the pneumatic jack is generally less expensive to manufacture, is lighter in weight and more easily transportable. A pneumatic jack has more universal applications and is more flexible in its use than a hydraulic jack because of the greater availability of its motive power, namely, compressed air. In a pneumatic jack, a reservoir for the spent fluid is not necessary, since the exhausted air can be readily discharged into the atmosphere. Furthermore, in work areas where jacks are needed, such as commercial garages, industrial plants and other locations, air compressors are usually more plentiful and available than hydraulic pumps.

On the other hand, in a closed-loop system, such as a hydraulic circuit, the hydraulic fluid, even though limited in amount, is usually maintained in the system with a minimum of leakage or cost. Moreover, hydraulic fluids are incompressible.

It is therefore an object of this invention to utilize a pneumatic system and a hydraulic system in a jack in order to maximize the advantages of both systems.

In the pneumatic jack made in accordance with this invention, the lifting force of the jack is essentially obtained from the pneumatic system, whereas the locking of the jack in its desired elevated position is maintained by a hydraulic system. Thus, the hydraulic system utilized in this pneumatic jack may be small, including a limited size reservoir and hydraulic piston relative to the overall size and lifting forces required for the jack.

The pneumatic jack made in accordance with this invention includes a relatively large lift plate mounted upon an expansible flexible annular wall or air bag supported upon a base member. Projecting upward from the base member within the air bag is a well chamber containing hollow telescoping cylindrical shaft sections defining an extensible shaft member, the top of which is fixed to the lift plate. A hydraulic fluid reservoir is in fluid communication with the well chamber through a releasable check valve, which permits the flow of hydraulic fluid from the reservoir into the well chamber only. A partition wall or diaphragm separates the reservoir into a hydraulic fluid chamber in fluid communication with the check valve, and a compressed air chamber in fluid communication with the interior of the expansible bag.

When compressed air is introduced into the bag, the bag expands, and the compressed air acts upon the relative large bottom surface of the lift plate to raise the jack head. The elevation of the lift plate causes the telescoping shaft member to extend upward, while the compressed air also acts upon the movable partition wall in the reservoir to force hydraulic fluid through the check valve into the expanding space within the hollow telescoping shaft sections.

Whenever the compressed air is removed, the jack head and lift plate will not fall because the column of hydraulic fluid within the hollow extensible shaft sections is trapped by the closure of the check valve.

When it is desired to lower the jack head or lift plate, air may be removed from the interior of the bag, and the check valve is overridden to permit reverse flow of the hydraulic fluid from the well chamber back into the reservoir.

The provision of the hydraulic locking mechanism in the pneumatic jack renders this pneumatic jack substantially more safe than conventional pneumatic jacks.

DESCRIPTION OF THE PREFERRED EMBODIMENT

Figure 1:
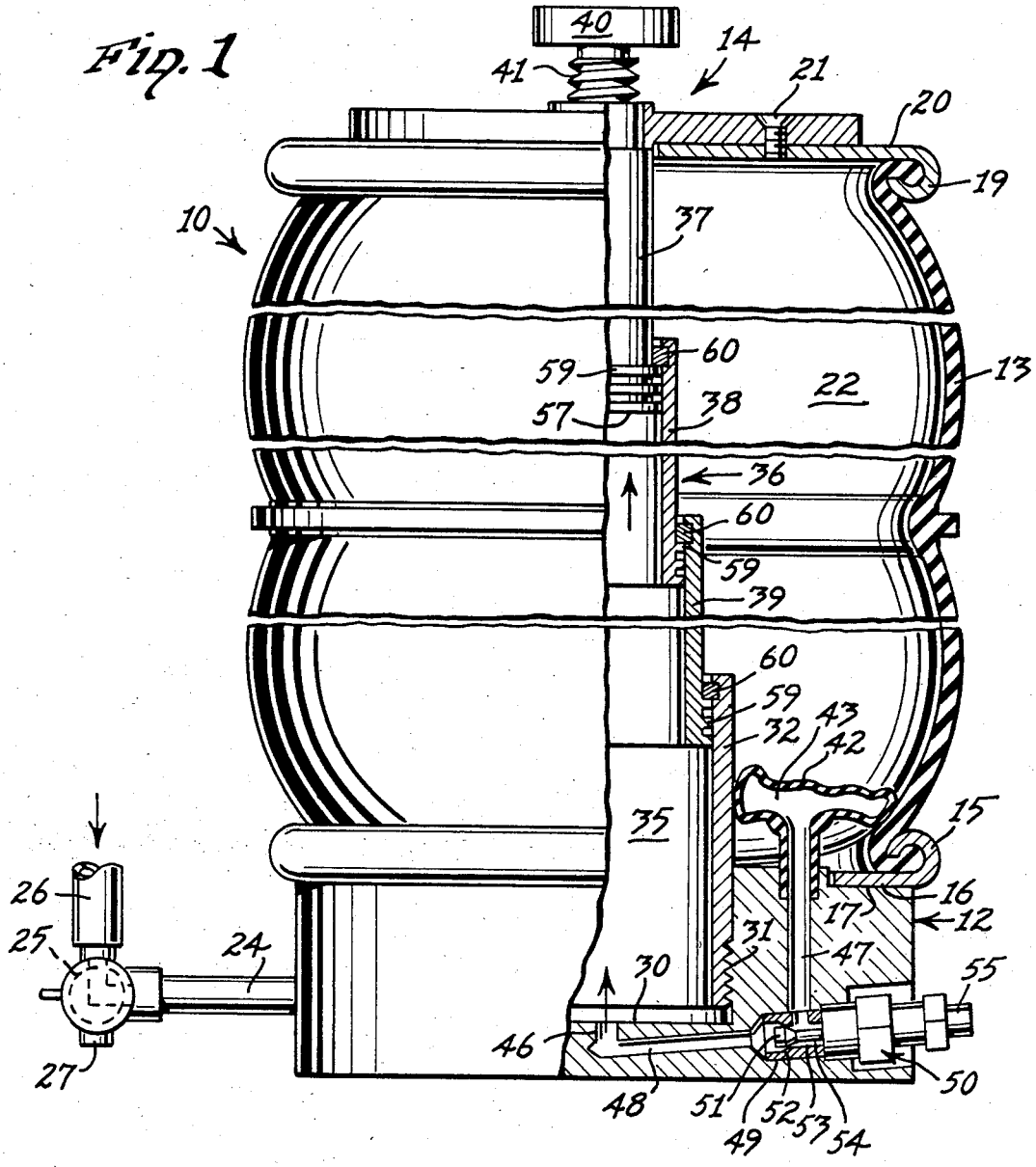
FIG. 1 is a side elevational view of the pneumatic jack made in accordance with this invention, with portions broken away and partially in section, in its extended position.
Figure 2:
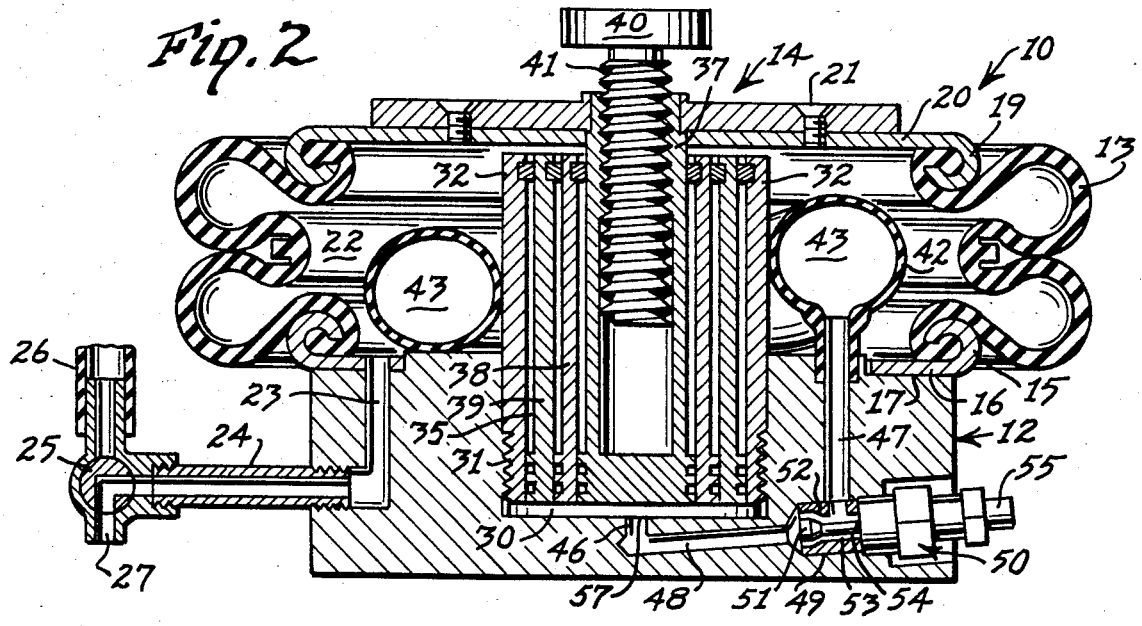
FIG. 2 is a side sectional elevation of the jack disclosed in FIG. 1, in its lowered position.

Referring now to the drawings in more detail, FIGS. 1 and 2 disclose a pneumatic jack 10, made in accordance with this invention, including a cylindrically shaped base member 12 adapted to rest upon a supporting surface, such as the ground or a floor, not shown. Concentrically mounted upon the base member 12 is an annular flexible wall member, bag member or bellows 13, carrying a circular lift plate member 14.

The bottom circumferential peripheral edge portion of the bag member 13 is clamped by the upward and inward directed, curled, peripheral edge 15 of an annular bottom mounting plate 16. The annular bottom mounting plate 16 may be secured in any convenient means, such as by bolts, not shown, to the annular ledge 17 of the base member 12.

The upper peripheral edge portion of the bag member 13 is likewise clamped by the downward and inwardly turned, curled, peripheral edge portion 19 of the top annular mounting plate 20, which in turn is fixed to the disc-shaped mounting plate or mounting plate member 14, by securing means, such as screws 21.

The enclosing top mounting plate 20, bottom mounting plate 16 and flexible annular wall member or bag member 13 completely enclose an expansible and collapsible air chamber 22.

An air inlet passage 23 in the base member 12 and in fluid communication with the air chamber 22, is connected through inlet pipe 24 to a rotary valve 25, which in turn alternately communicates with a compressed air supply pipe 26 and an exhaust port 27. As shown in FIG. 1, the rotary valve 25 has been rotated to its air supply position in which compressed air from an external source, such as air compressor, not shown, flows through the supply pipe 26, the port within the rotary valve 25, and the air inlet pipe 24, through the inlet passage 23 into the air chamber 22 to expand the bag member 13. By rotating the rotary valve 25 clockwise through 90° as disclosed in FIG. 2, the interior of the air chamber 22 is in direct fluid communication with the atmosphere through the exhaust port 27, so that the air from the chamber 22 may be relieved or exhausted.

It will be understood that the rotary valve 25, shown schematically, is examplary only, and other types of air inlet controls may be used in order to supply air and remove air selectively from the air chamber 22.

Threadly secured within a central bore 30 within the base member 12 by threads 31 is an upstanding cylindrical wall 32 which rises above the top surface of the base member 12 by a predetermined distance, to function as the inner wall of the air chamber 22.

The upstanding cylindrical wall 32 defines a well chamber 35 which is open at the top, and is adapted to receive an extensible plunger or shaft member 36, the upper end portion of which is fixed to the lift plate member 14.

The extensible plunger member 36 includes a plurality of telescoping hollow shaft sections, such as the three telescoping shaft sections 37, 38 and 39. The upper shaft section 37 is fixed concentrically to the lift plate member 14, and may be internally threaded to receive the externally threaded stem 41 of an annular disc-shaped jack head 40. Thus, the jack head 40 is vertically adjustable relative to the lift plate member 14.

The height of the respective shaft sections 37, 38 and 39 are such that the intermediate shaft section 38 and the lower shaft section 39 will be fully received within the well chamber 35 when the extensible plunger member 36 is fully collapsed, as disclosed in FIG. 2. The upper shaft section 37 is slightly longer than the shaft section 38 and 39 to support the top mounting plate 20 above the upper edges of the cylindrical wall 32 and the shaft sections 38 and 39, in collapsed position, as disclosed in FIG. 2.

An annular flexible toroidal diaphragm or tubular member 42 is concentrically mounted around the upstanding cylindrical wall 32 within the air chamber 22 to define an expansible and contractable hydraulic fluid reservoir chamber 43.

The lower end of the well chamber 35 and the hydraulic reservoir chamber 43 are in hydraulic fluid communication with each other through the respective depending fluid passages 46 and 47 and the connecting fluid passage 48. Received within a fluid chamber 49 between the connecting fluid passage 48 and the depending fluid passage 47 is a check valve member 50. The check valve member 50 includes a check valve 51 adapted to engage the valve seat 52 in order to close the valve passage 53, which communicates with the fluid passage 47. The valve 51 is fixed to one end of an elongated operating stem 54 which projects outwardly through the wall of the base member 12 and terminates in a control handle or push-button 55 adapted to be manually pushed to unseat the check valve 51 from its seat 52. The check valve 51 is adapted to be seated as disclosed in FIG. 1, when the pressure to the left of the check valve 51 and within the well chamber 35 is greater than the fluid pressure within the hydraulic reservoir chamber 43.

When the pneumatic jack 10 is assembled, a predetermined amount of hydraulic fluid, such as oil, will be introduced into the fluid charber 43 until the well chamber 35, fluid passages 46, 48, 53 and 47 are filled, and the hydraulic reservoir chamber 43 is filled to the expanded position of the tubular member 42, disclosed in FIG. 2, when the extensible plunger member 36 is in its lowermost, collapsed position. The dimensions of the well chamber 35 and reservoir chamber 43, will be such that the extensible plunger member 36 will be elevated to its uppermost elevated position when the tubular member 42 is substantially collapsed.

Thus, after the chambers 35 and 43 are filled with oil, no additional oil or hydraulic fluid will be needed. Moreover, the jack 10 will not require any hydraulic pump or external reservoir. The column or volume of hydraulic fluid within the chambers 35 and 43, as well as the interconnecting fluid passages, will function as an intermediate force-transmitting medium between the ram face 57, which is the bottom of the upper shaft section 37 (FIG. 2), and the flexible toroidal diaphragm 42.

In order to operate the jack 10, all of the parts of the jack 10 will be initially as disclosed in FIG. 2, in their lowermost positions. The inlet air valve 25 will be in its exhaust position disclosed in FIG. 2, in order to exhaust air from the air chamber 22. The jack 10 is then placed upon a supporting surface, not shown, under the object desired to be elevated, such as an automobile frame member not shown, with the jack head 40 located vertically beneath the frame member. Preferably the jack head 40 is rotated manually in a direction to cause the threaded stem 41 to move upwardly relative to the internally threaded shaft section 37. The jack head 40 is extended upwardly until it just touches the frame member desired to be elevated.

The inlet air line 26 is then connected to the discharge conduit or hose of an air compressor or other source of compressed air, not shown, and the rotary valve 25 is rotated to its charging position disclosed in FIG. 1.

Compressed air then flows through the inlet line 26, valve 25, inlet lines 24 and 23 into the air chamber 22, causing the bag member 13 to expand. The compressed air will also bear against the exposed lower surface of the top mounting plate 20. Substantially the entire bottom surface of the top mounting plate 20 is exposed to the air pressure to maximize the force exerted upon the lift plate member 14, causing the lift plate member 14 to rise. The area of the exposed bottom surface of the top mounting plate 20 is substantially greater than the exposed area of the ram face 57.

As the lift plate member 14 rises, it carries with it the upper telescoping shaft section 37 in which the jack head 40 is mounted. As the shaft section 37 continues to rise, it pulls up with it, sequentially, the intermediate shaft section 38 and the lower shaft section 39. As the telescoping shaft sections 37, 38 and 39 continue to rise, the reduced pressure in the connecting pipe 48 causes the valve 51 to unseat and open the passage 53, permitting hydraulic fluid from the reservoir 43 to pass through the valve passages 47 and 53. In effect, the rising shaft sections of the rising extensible shaft member 36 create a vacuum which draws hydraulic fluid from the hydraulic reservoir chamber 43 into the well chamber 35 and upward into the hollow shaft sections 38 and 39. The movement of the hydraulic fluid is also greatly assisted by the increasing air pressure within the chamber 22 which is transmitted through the wall of the tubular member 42.

The extension of the shaft sections 37, 38 and 39 is limited by the interlocking annular ribs 59 and 60 at the overlapping extremities of the shaft sections, as well as the upper end of the upstanding cylindrical wall 32.

Of course, the jack 10 does not have to be extended to its uppermost limit as disclosed in FIG. 1, but may be stopped by controlling the rotary valve 25 at any desired elevation between the extreme positions disclosed in FIGS. 1 and 2.

After the object or frame member, not shown, has been raised to its desired elevated position by the jack head 40, the air valve 25 may be rotated to a neutral closed position, such as a position about 45° from its position disclosed in FIG. 2, to hold the compressed air contained within the air chamber 22 and to hold the jack head 40 at the stationary elevated position.

Moreover, after the air inlet valve 25 has been closed, the weight of the elevated object downward upon the jack head 40 will create a greater hydraulic pressure in the connecting passage 48 than on the opposite side of the check valve 51, thereby forcing the valve 51 to close against its valve seat 52 and to close the valve passage 53. Thus, even if the air pressure within the air chamber 22 could not be maintained for any reason, such as leakage, the hydraulic column of fluid within the well chamber 35 would sustain the elevated position of the jack head 40.

In order to lower the jack 10, the valve 25 is rotated to its position disclosed in FIG. 2 until the ports within the valve 25 interconnect the pipe 24 and the exhaust port 27, to permit the air within the chamber 22 to exhaust through the port 27.

The push-button 55 is then manually thrust inward to force the check valve 51 away from its seat 52 to open the hydraulic fluid passages between the well chamber 35 and the hydraulic reservoir chamber 43.

The sheer weight of the elevated object downward upon the jack head 40 will cause the shaft sections to collapse downward toward the well chamber 35, simultaneously forcing the hydraulic fluid from the well chamber 35 throuoh the inter-connecting hydraulic fluid passages, at a controlled rate, back into the reservoir chamber 43 to cause the flexible tubular member 42 to expand to its original inflated position disclosed in FIG. 2. The downward movement of the lift plate member 14 will also cause the air within the chamber 22 to exhaust out through the valve 25.

It will thus be seen that the pneumatic jack 10 made in accordance with this invention combines the optimal advantages of pneumatic and hydraulic pressure transmitting fluids, and provides a more versatile jack, as well as a jack which is substantially safer than prior known pneumatic jacks. Furthermore, even though the jack combines pneumatic and hydraulic fluids, nevertheless, only a source of compressed air is needed to provide the motive force for elevating the jack 10.

What is claimed is:

1. A pneumatic jack comprising:

(a) a base member having a vertical central axis and adapted to rest upon a supporting surface, (b) an annular, closed, flexible wall member having a longitudinal axis, a bottom portion and a top portion, and enclosing an expansible air chamber, (c) means connecting the bottom portion of said annular wall member to said base member, (d) a jack head member secured to the upper portion of said annular wall member, (e) inlet means communicating with said air chamber for introducing compressed air into said air chamber for elevating said jack head, (f) an extensible plunger member fixed to said jack head and adapted to support a vertically expanding and contracting column of hydraulic fluid, (g) an expansible and contractible fluid reservoir adapted to receive hydraulic fluid and having a hydraulic fluid outlet opening, (h) check valve means in fluid communication between said fluid outlet opening and said plunger member to normally permit the flow of hydraulic fluid only from said reservoir to said plunger member when the hydraulic pressure in said reservoir exceeds the hydraulic pressure in said plunger member by a predetermined value, (i) relief means for permitting flow of hydraulic fluid from said plunger member into said reservoir, and (j) means for releasing the air pressure within said air chamber.

2. The invention according to claim 1 in which said fluid reservoir has a moveable wall member sensitive to the air pressure within said air chamber, so that when said air pressure exceeds a predetermined value, said movable wall member forces hydraulic fluid from said reservoir through said hydraulic fluid outlet opening and said check valve means to said plunger member.

3. The invention according to claim 2 in which said fluid reservoir, including said moveable wall member, is contained within said air chamber.

4. The invention according to claim 2 in which said movable wall member is flexible.

5. The invention according to claim 1 further comprising a lift plate member secured to said jack head and having a pressure bearing surface exposed to the compressed air within said air chamber, said plunger member having a ram face bearing on the column of hydraulic fluid in fluid communication with said plunger member, the pressure bearing surface of said lift plate member being substantially greater than the bearing area of said ram face.

6. The invention according to claim 1 in which said relief means comprises means for manually opening said check valve means to permit the free passage of hydraulic fluid between said plunger member and said reservoir.

7. The invention according to claim 1 in which said extensible plunger member comprises a well chamber in fluid communication with said check valve means, and a plurality of telescoping cylindrical shaft sections, including an upper most shaft section, adapted to be received in contracted position within said well chamber.

8. The invention according to claim 7 in which said plunger member comprises means mounting said jack head on said uppermost shaft section for vertical adjustable movement.

9. The invention according to claim 8 in which said means mounting said jack head on said uppermost shaft section comprises a depending threaded stem and a threaded vertical opening in said uppermost shaft section threadedly receiving said stem.

10. The invention according to claim 5 in which the vertical central axis of said base member, the longitudinal axis of said annular flexible wall member, and the longitudinal axis of said plunger member are coincidental, said lift plate member being annular and concentric with said vertical central axis.

11. The invention according to claim 6 further comprising a fluid conduit in said base member extending between said hydraulic fluid outlet opening and the bottom portion of said plunger member, said check valve means comprising a check valve within said fluid conduit, said relief means comprising a control member projecting from said check valve means outwardly through said base member to permit manual control of said control member.

* * * * *